United States Patent [19]

Naito et al.

[11] Patent Number: 4,986,198

[45] Date of Patent: Jan. 22, 1991

[54] METHOD OF CONTROLLING COMBUSTION IN FLUIDIZED BED INCINERATOR

[75] Inventors: Takeyuki Naito; Yoshiki Kuroda; Hiroshi Yoshida, all of Kanagawa, Japan

[73] Assignee: Ebara Corporation, Tokyo, Japan

[21] Appl. No.: 415,351

[22] PCT Filed: Apr. 30, 1988

[86] PCT No.: PCT/JP88/00437

§ 371 Date: Jul. 28, 1989

§ 102(e) Date: Jul. 28, 1989

[87] PCT Pub. No.: WO88/08504

PCT Pub. Date: Nov. 3, 1988

[30] Foreign Application Priority Data

May 1, 1987 [JP] Japan ..... 62-109552

[51] Int. Cl.[5] ..... F23G 3/00

[52] U.S. Cl. ..... 110/346; 110/188; 110/189; 110/190; 110/245; 122/4 D

[58] Field of Search ..... 110/188, 189, 190, 245, 110/346, 348; 431/7, 170; 122/4 D

[56] References Cited

U.S. PATENT DOCUMENTS 4,499,857 2/1985 Wormser ..... 110/188 X
4,742,783 5/1988 LaSpisa et al. ..... 110/188

FOREIGN PATENT DOCUMENTS 55-33510 3/1980 Japan .
57-127716 8/1982 Japan .
59-1912 1/1984 Japan .
0107111 6/1984 Japan ..... 110/188
59-195019 11/1984 Japan .
61-100612 5/1986 Japan .
61-110809 5/1986 Japan .

*Primary Examiner*—Edward G. Favors
*Attorney, Agent, or Firm*—Wenderoth, Lind & Ponack

[57] ABSTRACT

In a fluidized bed incinerator for burning matter to be incinerated charged into a furance by causing fluidization of a fluidizing medium with the assistance of air fed from the lower portion of a fluidized bed, a combustion control method is arranged such that: the combustion rate of matter for incineration in the furnace is detected by a combustion rate detecting means, and, when the combustion rate exceeds a predetermined level the amount of air fed from the lower portion of the fluidized bed is reduced; and, simultaneously, the amount of air blown into a space above the fluidized bed is increased so as to control and maintain the combustion rate of the matter to be burnt in the furnace at the predetermined level and to suppress fluctuations in the amount of combustion air, the amount of exhaust gas, the oxygen concentration in the exhaust gas and the amount of gas remaining unburnt or the like. The combustion control method is also applicable to a fluidized bed incinerator constructed to include a plurality of air chambers formed at the lower portion of the fluidized bed, through which chambers the air is fed into the incinerator and the combustion rate of matter for incineration is controlled by regulating the amount of air fed from the air chamber disposed at the portion where the matter charged is dropped.

23 Claims, 14 Drawing Sheets

U : SUPERFICIAL VELOCITY
Umf : MINIMUM SUPERFICIAL VELOCITY FOR FLUIDIZATION
G : FLUIDIZING MAGNIFICATION POWER

METHOD OF CONTROLLING COMBUSTION IN FLUIDIZED BED INCINERATOR

FIELD OF THE INVENTION

The present invention relates to a method of controlling combustion in a fluidized bed incinerator which is suited to inhibit the discharge of gas not yet burnt without causing fluctuations in the amount of air available for combustion and the amount of gas discharged by controlling the combustion rate of matters to be incinerated which is charged into a furnace, i.e., the combustion rate per unit time in a fluidized bed incinerator for burning matter to be incinerated by causing fluidization of a fluidizing medium such as sand or the like with the aid of air fed from the lower portion of a furnace bed. The fluidized bed incinerator used herein includes a fluidized bed boiler designed for heat recovery.

BACKGROUND OF THE INVENTION

Fluidized bed incinerators have heretofore been used for incinerating municipal refuse. Where municipal refuse is burnt in a fluidized bed incinerator, refuse is consecutively charged into it. In the great majority of cases, a tremendous amount of trash is charged in one mass with different articles entangled with each other and forced into an agglomerated mass. Fluidized bed incinerators have a rather higher rate of combustion than other types of incinerators, and also exhibit the advantage of providing in some cases a condition in which matter is well burnt. Paradoxically, this causes the drawback that, once the matter to be incinerated has been charged into the fluidized bed, it may be burnt within a few seconds because of the high combustion performance. For this reason, if the feeder used to feed the matter to be incinerated into the furnace is inferior in terms of maintaining a constant feed rate, there will be a problem in that any variation in the amount of matter to be incinerated which is charged into the furnace will directly lead to fluctuations in the concentration of oxygen contained in the combustion gas.

If the concentration of oxygen contained in the discharged combustion gas is approximately 5% or less, the critical amount depending on the type of fluidized bed incinerator, carbon monoxide and carbon hydrides such as methane, ethylene, propylene, acetylene and benzene will be discharged without being completely burnt. Thus, materials such as ammonium chloride and ammonium hydroxide will be generated, which lead to the emission of white smoke from the stack. Because fluidized bed incinerators exhibit high combustion performance, combustion can be effected so long as the superficial velocity of the fluidizing air is adequate for fluidization even if the theoretical air ratio of the fluidizing air blown into the fluidizing medium is smaller than 1. In order to inhibit the generation of unburnt gases such as carbon monoxide, however, the air ratio is increased. In some cases, extra air is fed beforehand so as not to reduce the concentration of oxygen even if the supply of the matter to be incinerated is increased to cope with the risk that the ability of the feeder to provide a constant feed rate will deteriorate.

The amount of air blown into the furnace is, at the maximum, twice as much as the theoretical quantity of air, depending on the ability of the feeder to ensure a constant feed rate. Even in this case, however, the various items of refuse are entangled with each other to form large agglomerated lumps, particularly when dealing with the municipal trash. Finally, a so-called massive drop takes place, leading momentarily to a lack of oxygen, and thus unburnt gas (not yet burnt) like carbon monoxide is sometimes discharged from the stack.

In prior art methods of inhibiting the discharge of unburnt gas, it has been necessary to improve the capability of the feeder to provide a constant feed rate. In addition, as disclosed in, e.g., Japanese patent application No. 223198/1984 (Japanese Patent Laid-Open No. 100612/1986), a measuring means may be provided for the purpose of measuring the amount of matter for incineration actually charged, allowing that amount to be reduced by lowering the rotational speed of the feeder when it is sensed that the amount of matter for incineration charged was increased.

Another method has been adopted whereby secondary fresh air is blown, into the incenerator when it is sensed that there has been an increase in the amount of matter charged or a shortage of oxygen has occurred.

Where a feeder is utilized in the conventional mode of inhibiting the discharge of unburnt gas, the potential for improvements in its ability to provide a constant feed rate is limited, with the result that expensive feeders have to be used.

The method disclosed in Japanese patent application No. 223198/1984 involves the use of a device for measuring the amount of matter charged. Use of this device, however, results in a shortage of oxygen, because the matter for incineration dropped into the furnace is immediately burnt. Secondary fresh air is blown into the furnace to compensate for this shortage, at which time the volume of exhaust gas is increased because of the introduction of the secondary air as well as the increase in exhaust gas resulting from the intensive combustion. Thus the pressure within the furnace becomes positive. When this positive pressure is sensed, an inlet damper of an induction fan is opened to normalize the furnace pressure. Therefore, if a good deal of matter for incineration is charged, the furnace pressure fluctuates, gas is injected through a exhaust gas duct flange and an ash-discharging rotary valve because of the positive pressure within the furnace, and this results in powdery dust contained in the exhaust gas being scattered which leads to a dusty environment in the plant.

Methods of controlling secondary fresh air to maintain the concentration of oxygen contained in exhaust gas at a certain level also involve the following inherent problems. Since the combustion rate of a fluidized bed incinerator is quite high, any fluctuation in the rate at which matter for incineration is fed into the furnace is directly reflected as unevenness in the rate at which gas is discharged, and hence the drawback mentioned above will also be encountered. A further problem is that the presence of a large amount of combustion air involves the provision of a large combustion fan and a large gas discharge inducing fan, which in turn requires that much power is consumed in driving these fans. Moreover, as the volume of gas discharged fluctuates the processing equipment installed for handling this gas which includes an exhaust duct, a gas cooler and an electric dust collector needs to have a large capacity to deal with the maximum possible flow of gas. This means that both the size of the incineration equipment and the total cost of construction are excessive.

In a conventional fluidized bed boiler, particularly in a fluidized bed boiler used for power generation, the quantity of coal fed into the boiler is varied to accord with any fluctuation in load, as is disclosed in Japanese Patent Laid-Open Publication No. 1912/1984. Whenever the quantity of fuel being supplied is increased the rate of combustion is controlled by a method of regulating the feed rate of fluidizing air fed from the lower portion of the fluidized bed so that the temperature of the fluidizing medium in the fluidized bed is not in excess of a predetermined value. Even with use of this combustion control method, it has been impossible to inhibit the discharge of unburnt gas without causing fluctuations in the respective amounts of combustion air and exhaust gas while at the same time restraining sudden fluctuations in combustion rate, especially when the amount of matter to be incinerated charged into the furnace varies in a fluidized bed incinerator for incinerating such matter as municipal refuse, since such refuse comprises a mixture of various constituents differing from each other in bulk, configuration, combustibility and calorific value.

It is to be noted that the combustion rate is herein given by: calorific value (kcal/kg) x volume of material for incineration (amount of matter for incineration) (kg/time).

The present invention has been conceived in the light of these circumstances and it is a primary object of the present invention to obviate the above-mentioned problems incidental to the prior art by providing a combustion control method for application to a fluidized bed incinerator which is capable of inhibiting the discharge of unburnt gas without increasing the respective amounts of combustion air and exhaust gas and without any need for an expensive feeder having a high capability to ensure a constant feed rate even if matter to be incinerated such as coal, municipal refuse, industrial scraps or mixtures thereof with differing calorific values, rates of combustibility, configurations and bulk volumes is charged into the incinerator and the amount of matter so charged fluctuates.

SUMMARY OF THE INVENTION

To accomplish the above-described object, according to one aspect of the invention, there is provided a combustion control method for application to a fluidized bed incinerator for burning matter to be incinerated which is charged thereinto by causing fluidization of a fluidizing medium with the assistance of air fed from the lower portion of a fluidized bed, the method being characterized by the steps of: monitoring the combustion rate of the matter for incineration burnt in the fluidized bed incinerator; decreasing the combustion rate of the matter for incineration in the furnace when the combustion rate of the matter charged exceeds a predetermined level by reducing the amount of air fed from the lower portion of the fluidized bed, and simultaneously increasing the amount of air blown into a space above the fluidized bed to maintain the combustion rate of the matter for incineration at a constant level.

According to another aspect of the invention, there is provided a combustion control method in a fluidized bed incinerator in which the fluidizing medium is fluidized by air fed from a plurality of air chambers disposed at the lower portion of a fluidized bed thereof, the method being characterized by the steps of: reducing the rate of air blown by a predetermined amount in accordance with the amount of matter for incineration charged into the incinerator when the amount of such matter charged thereinto rises above a predetermined quantity, the air being fed from air chambers provided at the portion where the matters for incineration is dropped, and simultaneously increasing the flow rate of air fed from the other air chambers in accordance with the amount of matter for incineration charged there into and directing the air to a space above the fluidized bed so as to moderate the fluidizing mode of the fluidizing medium at the portion where the matter for incineration is dropped and to activate the fluidization mode of the fluidizing medium at the place surrounding said portion whereby the combustion rate can be controlled.

BRIEF DESCRIPTION OF THE DRAWINGS

FIG. 6(A) is a diagram illustrating a case of employing the conventional combustion control method; FIG. 6(B) is a diagram illustrating a case of employing the combustion control method in accordance with the present invention;

THE BEST MODE OF PRACTICING THE INVENTION

The mode of practice of the present invention will now be described with reference to the accompanying drawings.

It is quite difficult to directly measure the combustion rate of matter to be incinerated in a fluidized bed incinerator. The combustion rate may be indirectly detected by intra-furnace brightness, the concentration of oxygen contained in exhaust gas, intra-furnace pressure, intra-furnace temperature, or the quantity, bulk and/or properties of the matter charged into the furnace.

Figures 1A, 1B, 1C:
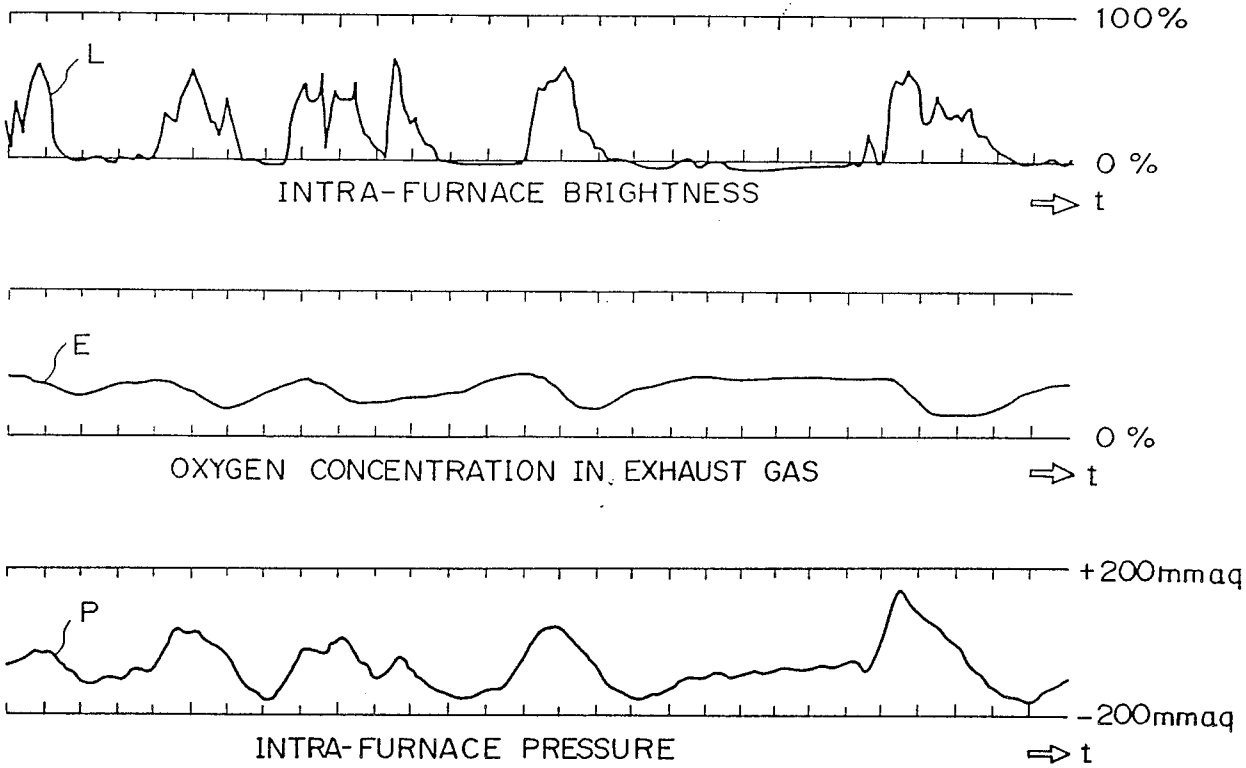
FIGS. 1(A), 1(B) and 1(C) are diagrams showing brightness in a fluidized bed incinerator, the concentration of oxygen contained in exhaust gas, and actually measured results of fluctuations in intra-furnace pressure, respectively.

FIGS. 1(A) to 1(C) are diagrams illustrating actually measured results of the combustion rate in the above-mentioned fluidized bed incinerator which is represented by intra-furnace brightness L, oxygen concentration E (in the exhaust gas) and intra-furnace pressure P. Note that the axis of abscissa indicates the time t (one gradation on the scale is equivalent to 5 sec). In a fluidized bed incinerator, as shown in these drawings, the intra-furnace brightness L, the oxygen concentration E in the exhaust gas and the intra-furnace pressure P vary in response to fluctuations in the combustion rate. The present invention is directed to maintaining the combustion rate at a constant level by the steps of estimating the combustion rate from the intra-furnace brightness L, the oxygen concentration E in the exhaust gas and the intra-furnace pressure P, regulating the amount of fluidized air fed from the lower portion of the fluidized bed based on that estimate and suppressing abrupt fluctuations in the combustion rate even if the amount of matter for incineration charged into the furnace varies.

Figure 2:
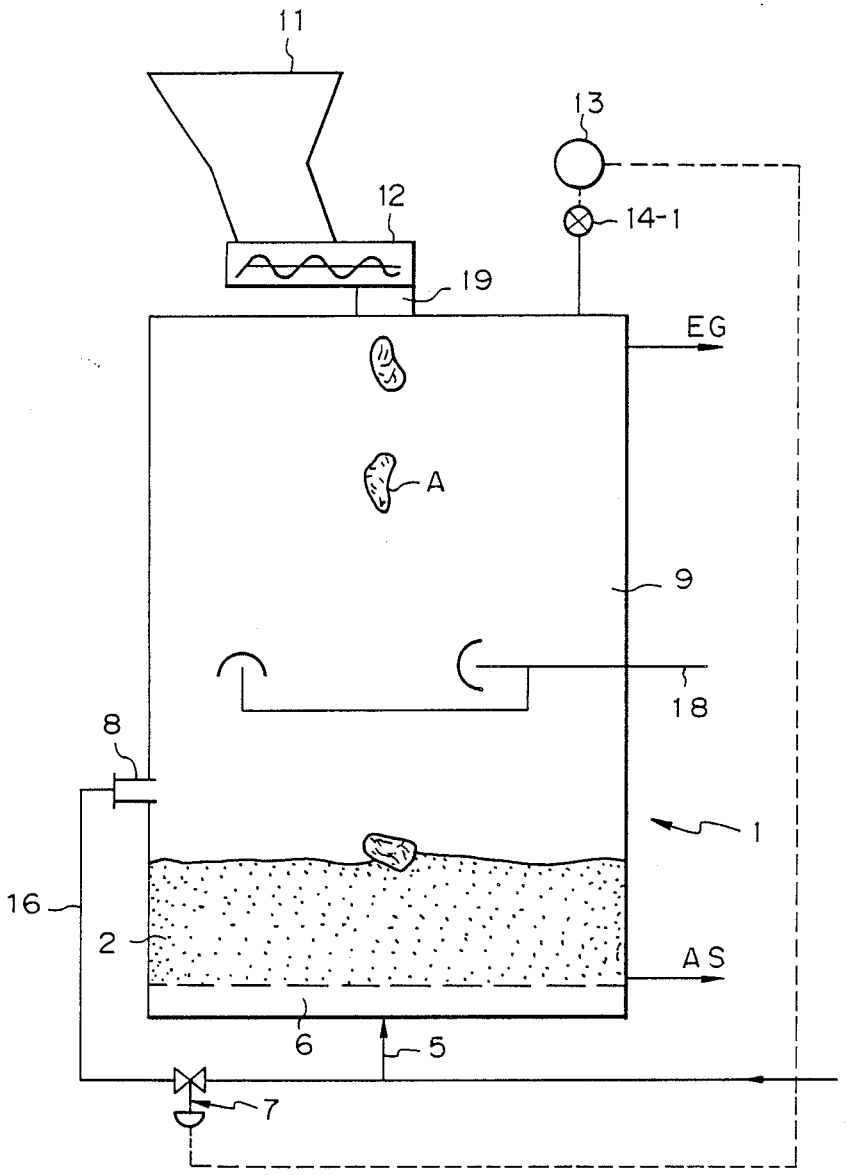
FIG. 2 is a block diagram schematically illustrating the construction of a fluidized bed incinerator in which a combustion control method according to the present invention is practiced.

FIG. 2 is a block diagram schematically showing the construction of a fluidized bed incinerator in which the combustion control method of the present invention is practiced. Referring to FIG. 2, numeral 1 designates a furnace within which a fluidized bed 2 is formed where a fluidizing medium such as sand or the like is fluidized. Provided at the lower portion of the fluidized bed 2 is an air chamber 6 through which fluidizing air is fed from a fluidizing blower (not illustrated) via a pipe 5 into the furnace 1 to cause fluidization of the fluidizing medium. The blower may comprise, e.g., a centrifugal blower which is preferably regulated so that its discharge rate is maintained at a constant level during operation. The reference numeral 11 denotes a hopper for charging matter to be incinerated such as municipal refuse. A feeder 12 for feeding such matter into the furnace 1 is provided at the lower portion of the hopper 11. The numeral 14-1 represents a detecting sensor for detecting brightness in the furnace 1; and 13 stands for a controller utilized to regulate the degree of opening of a valve on the basis of a measured value of the brightness in the furnace 1. An air nozzle 8 is disposed on a wall of the furnace 1 for blowing air into a space above the fluidized bed 2. A control valve 7 is connected via a pipe 16 to the air nozzle 8. The control valve 7 may be interposed either in the pipe 5 or in the pipe 16. The pipes 16 and 5 may be connected respectively to other blowers instead of the arrangement in which the pipe 16 bypasses the pipe 5. In the drawing, the numeral 9 denotes a free board portion, and 18 represents a secondary air introducing pipe. The brightness detecting sensor 14-1 is disposed at a suitable height above a secondary air introducing port in such a position that the entire cross-section of the furnace can be observed, allowing the brightness in the furnace 1 which is produced by the combustion of matter for incineration A to be detected without being influenced by the fluidizing medium or the brightness of the furnace wall. In the drawing, the symbol EG represents exhaust gas which is discharged from a exhaust gas outlet, and AS indicates ash which is discharged from an ash outlet.

In the fluidized bed incinerator explained above, the matter A charged from the feeder 12 into the furnace 1 is dropped on a certain portion of the fluidized bed 2, i.e., on the central portion thereof. In this case, though not illustrated, the matter A may be dispersed by using a spreader. If the quantity of matter A charged into the furnace 1 is larger than usual, the rate of combustion (per unit time) of the matter being incinerated becomes high and the brightness in the furnace 1 increases. Thus the output of the brightness detecting sensor 14-1 is also raised. As the brightness of the furnace 1 increases, the controller 13 serves to open the control valve 7, so that a part of the air fed from the air chamber 6 is blown from the air nozzle 8 via the pipe 16 into the space above the fluidized bed 2. As a result, the amount of air fed from the air chamber 6 is reduced, and hence the fluidization mode of the fluidizing medium in the fluidized bed 2 is moderated. This has the consequence of reducing the effect of heat-transfer from the fluidizing medium to the matter A being incinerated, thereby causing a reduction in the rate at which the matter is gasified. In other words, the speed of combustion is slowed. At this time, the amount of oxygen in the fluidized bed 2 decreases due to the reduction in the amount of air supplied from the air chamber 6. On the other hand, the amount of unburnt gas increases in proportion to the reduction in the amount of air flowing from the chamber 6. However, it follows from this that the unburnt gas is burnt in the space in the free board portion 9 or the like which is above the fluidized bed 2, because the amount of air injected through the air nozzle 8 is increased.

An amount of air equivalent to the reduction in the amount of air supplied from the air chamber 6 may be supplied through either the air nozzle 8 or the secondary air introducing port or may be blown through both by a suitable distribution arrangement. In short, what should be done is to blow the air into the free board portion in sufficient quantity to burn the unburnt gas.

Figure 3:
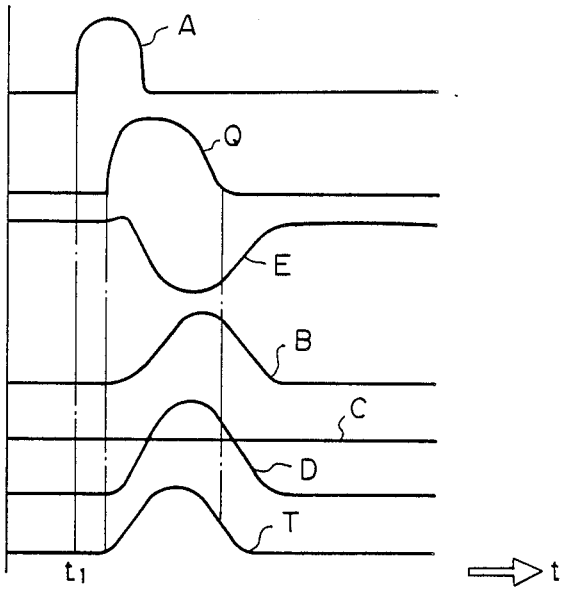
FIG. 3 is a diagram illustrating fluctuations in the amount of combustion, the concentration of oxygen contained in exhaust gas, the amount of exhaust gas, the amount of primary air, the amount of secondary air and the intrafurnace temperature with respect to variations over time in the quantity of matter for incineration charged into a fluidized bed incinerator according to a conventional combustion control method.
Figure 4:
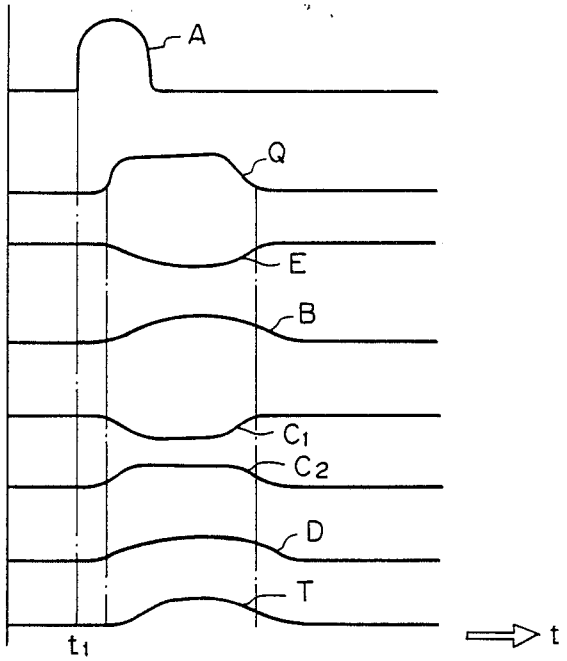
FIG. 4 is a diagram illustrating fluctuations in the amount of combustion, the concentration of oxygen contained in the exhaust gas, the amount of exhaust gas, the amount of primary air, the amount of secondary air and the intrafurnace temperature with respect to variations over time in the quantity of matter for incineration charged into a fluidized bed incinerator by the combustion control method according to the present invention.

FIG. 3 is a diagram illustrating fluctuations in amounts of combustion rate, concentration of oxygen contained in exhaust gas, amount of exhaust gas, amount of fluidizing air (primary air), amount of secondary air and intra-furnace temperature relative to the lapse of time with respect to variations in the quantity of matter for incineration charged into a fluidized bed incinerator using a conventional combustion control method. FIG. 4 is a diagram illustrating the fluctuations in amounts of combustion rate, concentration of oxygen contained in exhaust gas, exhaust gas, fluidizing air (primary air) and secondary air and in intra-furnace temperature relative to the lapse of time with respect to variations in the quantity of the matter for incineration charged into a fluidized bed incinerator using the combustion control method according to the present invention. In the drawings, the axis of abscissa indicates the time t.

In the prior art, as illustrated in FIG. 3, a primary air quantity C supplied from the lower portion of the fluidized bed 2 via the air chamber 6 is kept constant and when the matter A is charged at a timing $t_1$, gasification instantaneously commences. After a few seconds, combustion is initiated, and the combustion rate Q increases, while the oxygen concentration E in the exhaust gas abruptly decreases. When the oxygen concentration is low, unburnt gas is discharged, and thus the secondary air quantity D is increased in response to the drop in oxygen concentration in the exhaust gas, while the exhaust gas quantity B also increases. The intra-furnace temperature T is also raised, because the combustion rate Q becomes high. With continued incineration, the amount of material not yet burnt in the furnace 1 becomes lower, and the oxygen concentration E in the exhaust gas is increased. Thus the secondary air quantity D is made smaller and the exhaust gas quantity B is reduced such as to lower the intra-furnace temperature.

In contrast, in a case where the combustion control method according to the present invention is utilized, assuming the matter for incineration A is charged at the timing $t_1$ and the combustion rate Q is increased as shown in FIG. 4, the brightness in the furnace 1 is also increased. When the output of the brightness detecting sensor 14-1 is raised, the controller 13 functions to open the control valve 7, whereby an amount of air equivalent to a primary air quantity $C_2$ is blown into the space above the fluidized bed 2 and, accordingly, the primary air quantity $C_1$ representing the amount of air supplied from the air chamber 6 is reduced. The reduction in the quantity of primary air $C_1$ fed from the air chamber 6 causes a drop in the rate of increase of the combustion rate Q. Thus combustion is retarded so that the oxygen concentration E in the exhaust gas is also reduced, not abruptly but moderately. In addition, the secondary air quantity D is increased in proportion to the drop in the oxygen concentration E in the exhaust gas, and hence there is no substantial fluctuation in the oxygen concentration E in the exhaust gas. Because the rate of increase of the combustion rate Q is slowed, the rate of increase in the intra-furnace temperature T is also reduced. When the combustion rate Q is reduced, the control valve 7 is closed to reduce the primary air quantity $C_2$ from the air nozzle 8 and to increase the primary air quantity $C_1$ from the air chamber 6. Due to this increase in the primary air quantity $C_1$ the fluidization mode of the fluidizing medium in the fluidized bed 2 is activated so that the operation reverts to the normal condition.

As described above, with the rise in the combustion rate Q, the primary air quantity $C_1$ from the air chamber 6 is reduced, whereas the primary air quantity $C_2$ from the air nozzle 8 is increased. The secondary air quantity D is supplied in proportion to the moderate reduction in the oxygen concentration E in the exhaust gas and, thus, the increase in exhaust gas quantity B is quite small.

The increase (decrease) in the secondary air quantity is preferably equal to the decrease (increase) in the primary air quantity. However, the increase (decrease) may be ±30% of the decrease (increase) of the primary air quantity.

Figures 5A, 5B, 5C:
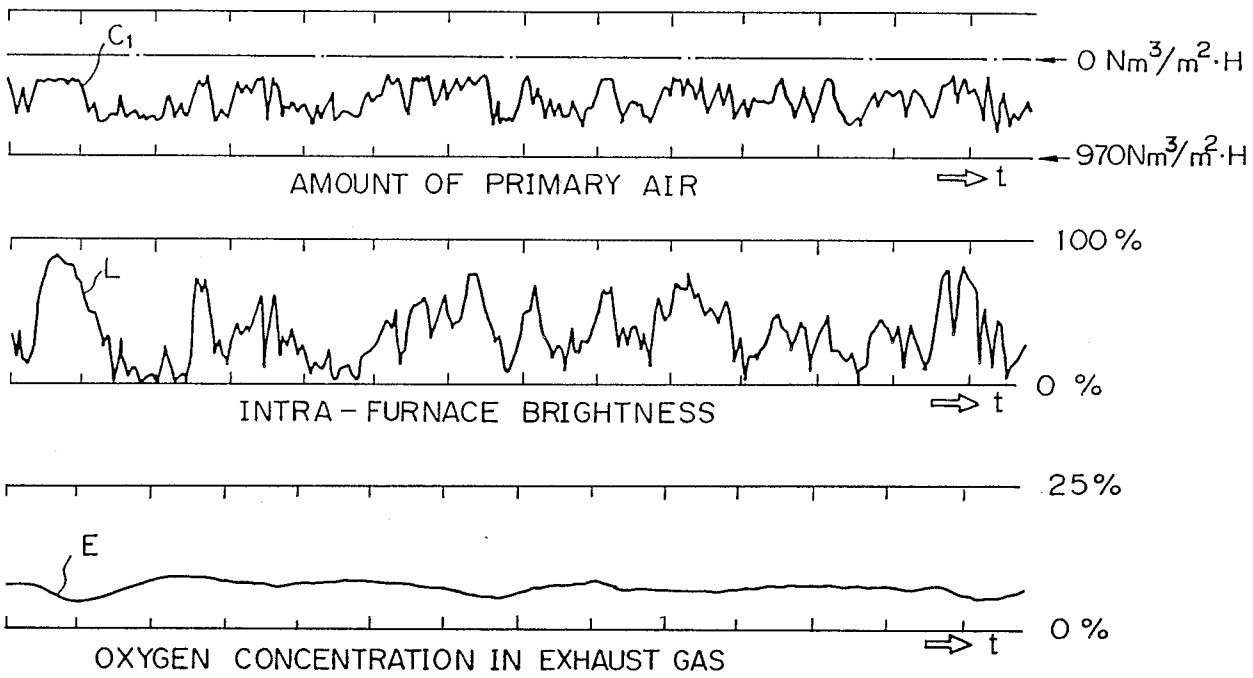
FIGS. 5(A), 5(B) and 5(C) are diagrams showing actually measured results of the amount of primary air, the brightness in the furnace and the concentration of oxygen contained in the exhaust gas in applying the combustion control method based on intra-furnace brightness according to the present invention.

FIG. 5 is a group of diagrams showing actually measured results obtained by controlling the combustion rate after controlling the primary air quantity $C_1$ supplied from the air chamber 6 on the basis of intra-furnace brightness L, viz., the output of the brightness detecting sensor 14-1. FIG. 5(A) illustrates fluctuations in the primary air quantity $C_1$ ($Nm^3/m^2 \cdot H$). FIG. 5(B) illustrates fluctuations in the intra-furnace brightness L (%). FIG. 5(C) illustrates fluctuations in the oxygen concentration E (%) in the exhaust gas. The axis of abscissa indicates the time t (one gradation on the scale is equivalent to 17 sec).

As shown in these drawings, the primary air quantity $C_1$ fed from the air chamber 6 is controlled on the basis of the intra-furnace brightness L, thereby remarkably moderating any fluctuations in the oxygen concentration E in the exhaust gas. It can therefore be confirmed that the combustion becomes moderate (the combustion speed is slowed), and is then stabilized.

Figure 6A:
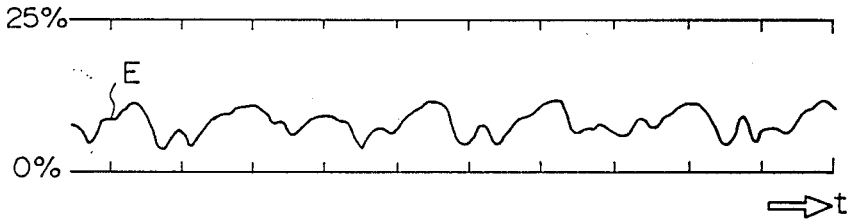
FIGS. 6(A) and 6(B) in combination show actually measured results of the concentration of oxygen contained in exhaust gas.
Figure 6B:
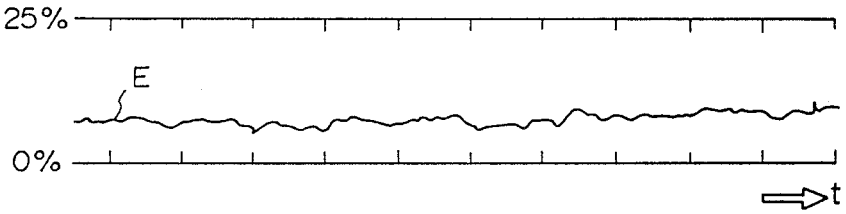

FIG. 6 is a group of diagrams, showing the actually measured results of the oxygen concentration E in the exhaust gas obtained by the combustion control methods according to the prior art and the present invention. FIG. 6(A) illustrates a case of employing the prior art combustion control method, while FIG. 6(B) illustrates a case of using the combustion control method of the present invention. In the drawing, the axis of ordinate indicates the oxygen concentration E (%) in the exhaust gas, while the axis of abscissa indicates the time t (one gradation on the scale represents 200 sec). As shown in the drawing, it can be confirmed that the range of fluctuation in the oxygen concentration E in the exhaust gas achieved in the combustion control method of the present invention is smaller than that in the prior art combustion control method.

Figure 7:
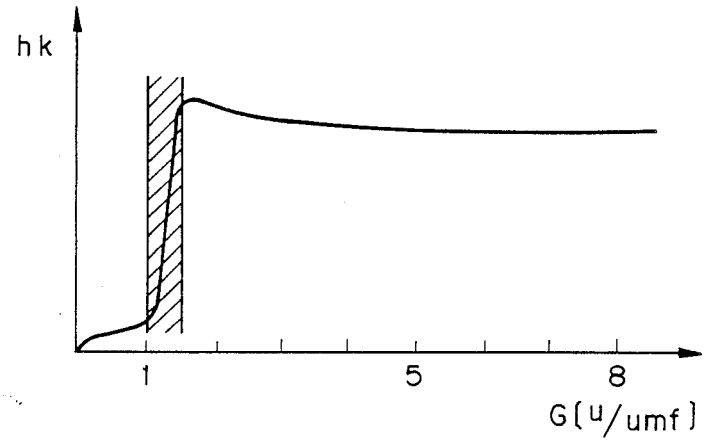
FIG. 7 is a diagram explaining the relationship between fluidizing magnification power G (U/Umf) and heat-transfer coefficient $h_k$ in a fluidized bed incinerator.
Figure 8:
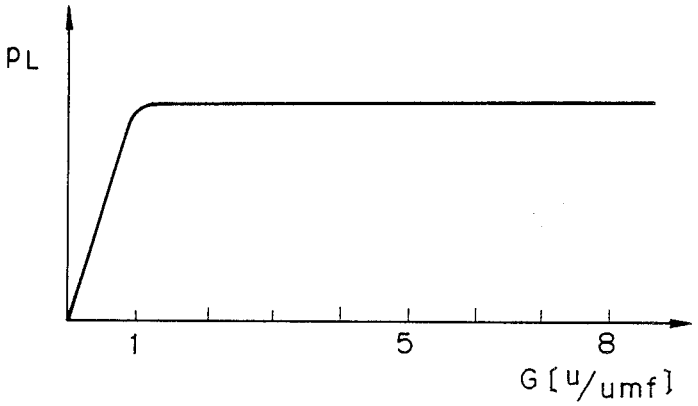
FIG. 8 is a diagram showing a relationship between fluidizing magnification power G (U/Umf) and a pressure loss $P_L$.

The combustion control method according to the present invention will be explained in greater detail with reference to FIGS. 7 and 8. FIG. 7 is a diagram showing the relationship between fluidizing magnification power G (U/Umf) and heat-transfer coefficient $h_k$ in the fluidized bed incinerator; and FIG. 8 is a diagram illustrating the relationship between the fluidizing magnification power G (U/Umf) and pressure loss $P_L$, wherein U is the superficial velocity and Umf is the minimum fluidizing superficial velocity (minimum superficial velocity at which the fluidizing medium is fluidized).

The conventional fluidized bed incinerator is operated with the superficial velocity U of the fluidizing air determined to be such that the fluidizing magnification power G is within the range of from 4 to 10 (U/Umf) (700 to 1500 $Nm^3/m^2 \cdot H$). Hence, the heat-transfer coefficient $h_k$ is kept almost constant and there is a limit in controlling the gasification rate of the matter being incinerated even if the superficial velocity of the fluidizing air is changed. A fluidized bed incinerator run with the combustion control method of the present invention is operated with the fluidizing air blown at the superficial velocity U and with the fluidizing magnification power 1 to 4 (U/Umf) (250 to 700 $Nm^3/m^2 \cdot H$) which is lower than in the case of conventional operations. If the combustion rate Q of the matter being incinerated is increased beyond a predetermined level, the superficial velocity of the fluidizing air is shifted to the range defined by oblique lines in FIG. 7, viz., the range in which the fluidizing magnification power G slightly exceeds 1 (U/Umf). It is therefore possible to change the heat-transfer coefficient $h_k$. For this reason, it is now possible to provide a method of controlling the gasification rate by simply varying the superficial velocity of the fluidizing air and this method also makes it possible to control the gasification rate of the matter being incinerated more efficiently.

Figure 9A:
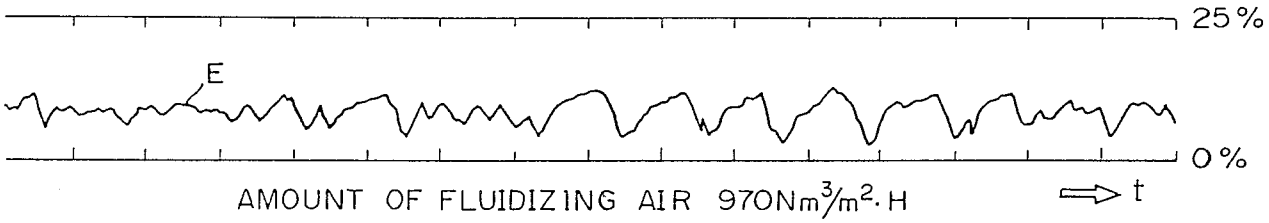
FIGS. 9(A) and 9(B) are diagrams each showing actually measured results of fluctuation in the concentration of oxygen contained in exhaust gas when municipal refuse is incinerated using different amounts of fluidizing air in the fluidized bed incinerator, respectively.
Figure 9B:
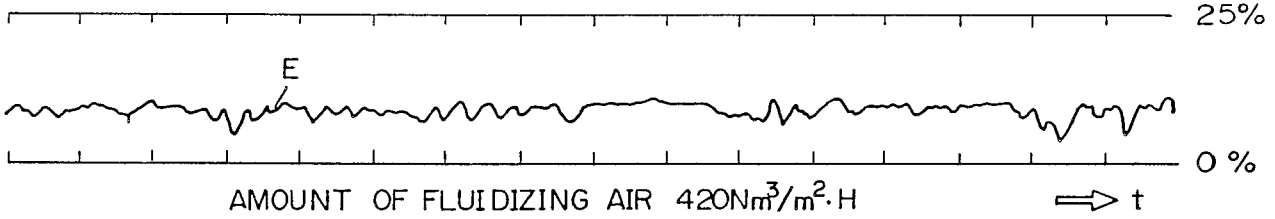

FIG. 9 is a diagram showing variations in the oxygen concentration E in exhaust gas when municipal refuse is incinerated in a fluidized bed incinerator by changing the amount of fluidizing air. FIG. 9(A) illustrates a case where the fluidizing air quantity is 970 ($Nm^3/m^2 \cdot H$). FIG. 9(B) illustrates a case where the fluidizing air quantity is 420 ($Nm^3/m^2 \cdot H$). In the drawing, the axis of abscissa indicates the time t (one gradation represents 100 sec). As shown, if the fluidizing air quantity is as much as 970 ($Nm^3/m^2 \cdot H$), the charged refuse is gasified instantaneously and fluctuations in the amount charged lead directly to variations in the oxygen concentration in the exhaust gas. Therefore, even if the combustion speed is regulated, the fluctuations are so large that the variations in both the oxygen concentration and the carbon monoxide become excessive. In contrast, where the amount of fluidizing air is 420 ($Nm^3/m^2 \cdot H$), the combustion stabilizes to a moderate state (the combustion speed becomes slow) and these fluctuations are thereby minimized.

With combustion in the fluidized bed incinerator being controlled in the above-described manner, combustion can be utilized to incinerate various kinds of materials such as coal, municipal refuse, industrial refuse and mixtures thereof whose calorific values, combustibility, configuration and bulk density differ from each other and this can be done without any need to significantly regulate the amount of combustion air, exhaust gas and unburnt gas, or the concentration of oxygen contained in the exhaust gas, etc. Additionally, the materials to be burnt may be charged into the fluidized bed incinerator without pre-shredding and can be incinerated in that state.

Figure 10:
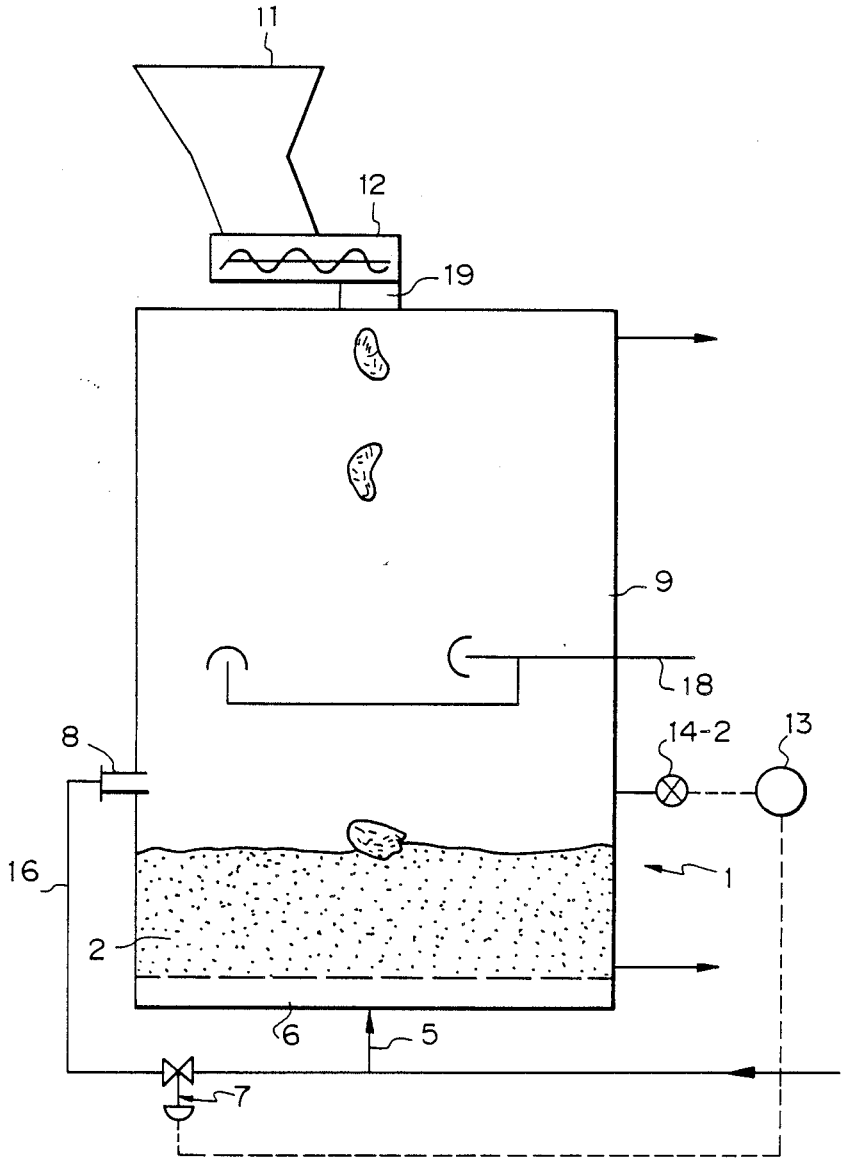
FIG. 10 is a block diagram schematically illustrating the construction of another fluidized bed incinerator in which the combustion control method according to the present invention is practiced.

FIG. 10 shows a schematic block diagram of a fluidized bed incinerator in which the combustion rate of the matter to be incinerated in the furnace 1 is controlled by detecting the pressure within the furnace 1. In FIG. 10, the components are marked with the same reference numerals as those used in FIG. 2 to indicate the portions that are the same as or correspond to components shown in the latter. Provided above the fluidized bed 2, as shown, is a pressure detecting sensor 14-2 for detecting the intra-furnace pressure, the output of which is transmitted to the controller 13.

Based on the incineration as above with the combustion rate being controlled, if a large amount of the matter A is charged into the furnace 1, the combustion rate (per unit time) thereof becomes large and the amount of exhaust gas generated also increases. Therefore, as seen in FIG. 1(C), the intr-pressure of the furnace 1 is raised, and thus the output of the pressure detecting sensor 14-2 is also increased. When the internal pressure of the furnace 1 increases, the controller 13 serves to open the control valve 7, thereby increasing the amount of air to be injected from the air nozzle 8 into the space above the fluidized bed 2. Accordingly, the amount of air blown up from the air chamber 6 is reduced, and the fluidizing mode of the fluidizing medium in the fluidized bed 2 is therefore moderated to thereby reduce the amount of heat transferred from the fluidizing medium to the matter A being incinerated, which in turns lead to a reduction in the speed at which the matter A is gasified and a slowing of the incineration rate. At this time, the quantity of oxygen in the fluidized bed 2 is reduced due to the decrease in the amount of air blown up from the air chamber 6, and the amount of gas not yet burnt increases correspondingly. However, this unburnt gas is incinerated by blowing air into the space such as a free board portion 9 above the fluidized bed 2, utilizing either the air nozzle 8 or the secondary air introducing port, or utilizing both.

In this case, an amount of air equivalent to the reduced amount of primary air may be supplied through the nozzle 8 as primary air $C_2$.

Figures 11A, 11B, 11C:
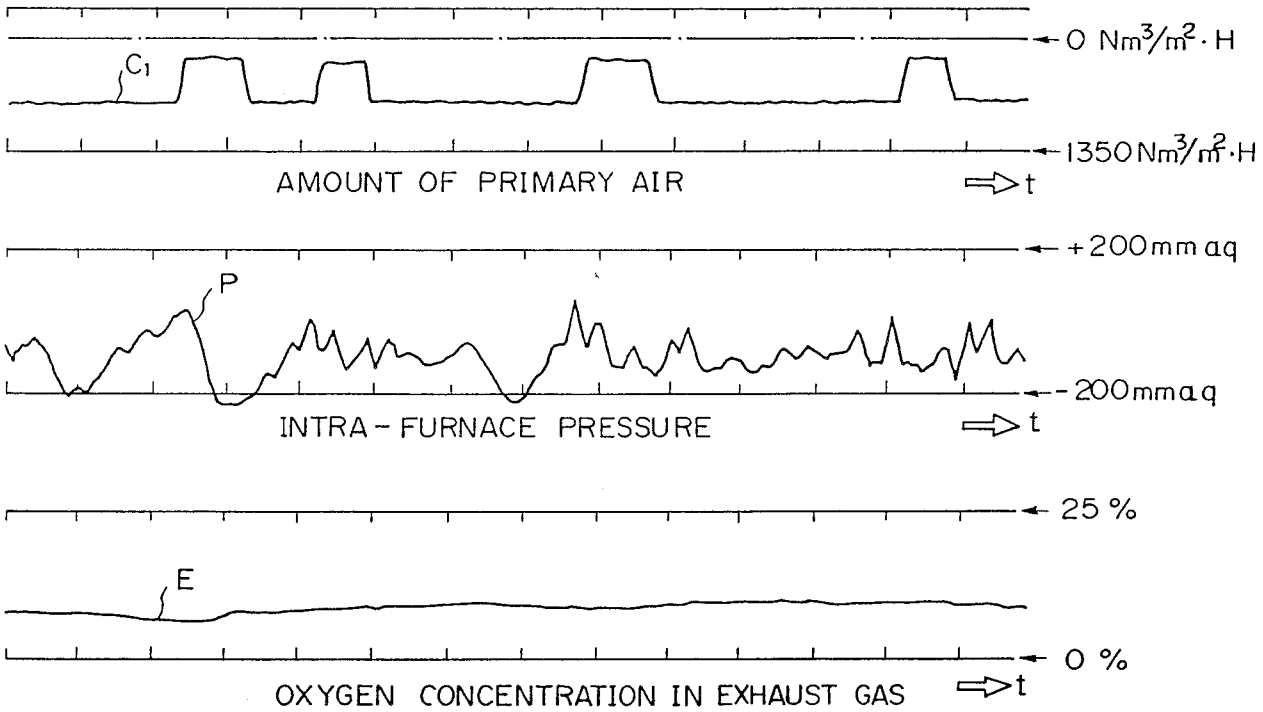
FIGS. 11(A), 11(B) and 11(C) are diagrams showing the actually measured results of fluctuations in the amount of primary air, the intra-furnace pressure and the concentration of oxygen contained in exhaust gas, respectively, in applying the combustion control method based on the intra-furnace pressure according to the present invention.

FIG. 11 is a diagram showing actually measured results achieved by regulating the amount of primary air $C_1$ supplied from the air chamber 6 based on the output of the pressure detecting sensor 14-2 so as to control the combustion rate. FIG. 11(A) illustrates fluctuations in the amount of primary air $C_1$ ($Nm^3/m^2 \cdot H$); FIG. 11 (B) illustrates fluctuations in the intra-furnace pressure P (mmaq); and FIG. 11(C) illustrates fluctuations in the oxygen concentration E (%) in the exhaust gas. The axis of abscissa indicates the time t (one gradation on the scale represents 17 sec).

As seen in the drawing, the fluctuation in the oxygen concentration E in the exhaust gas is markedly moderated by regulating the amount of primary air $C_1$ supplied from the air chamber 6 based on the intra-furnace pressure P. Namely, it is clear that the rate of combustion is made moderate (the combustion speed is slowed) and then stabilized.

Figure 12:
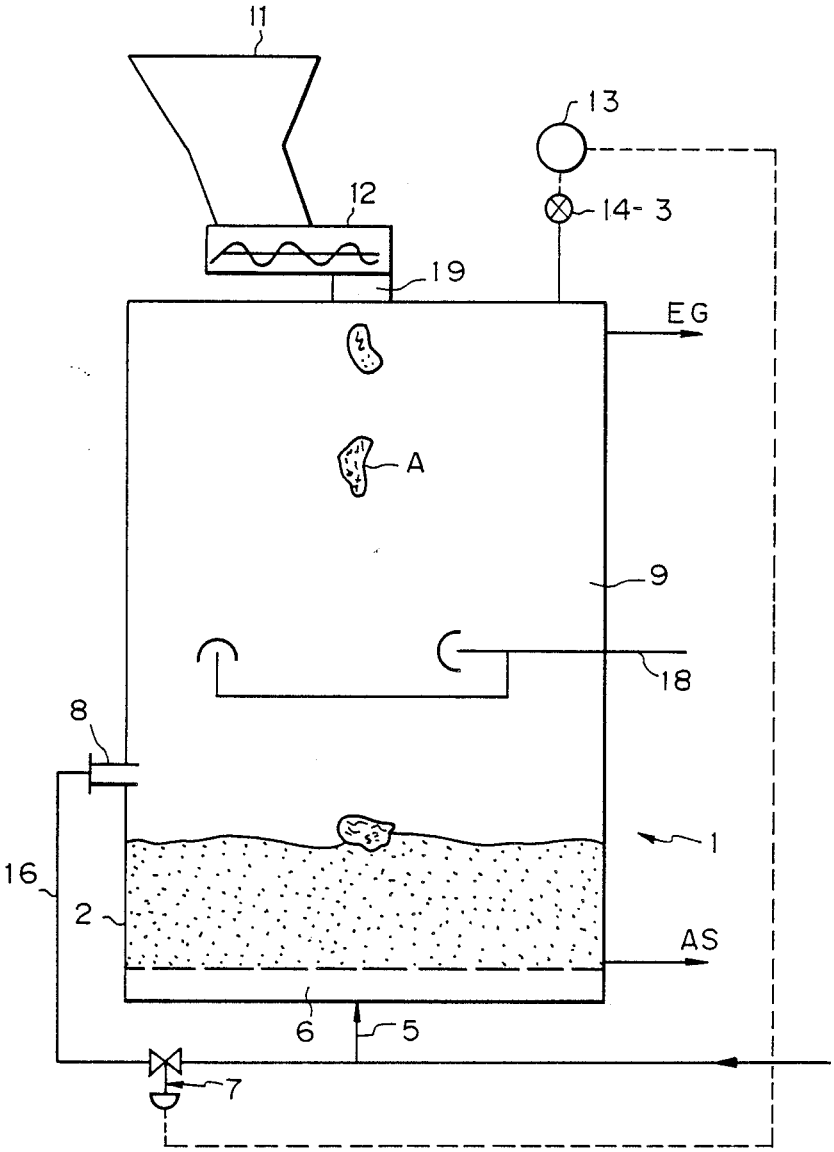
FIG. 12 is a block diagram schematically showing the construction of another fluidized bed incinerator in which the combustion control method according to the present invention is practiced.

FIG. 12 is a schematic block diagram of a fluidized bed incinerator in a case where the combustion rate of the matter being incinerated in the furnace is controlled based on detection of the oxygen concentration in the exhaust gas. In FIG. 12, the components are marked with the same reference numerals as those used in FIG. 2 to indicate the portions which are the same as or correspond to the components shown in the latter. As illustrated in the drawing, an oxygen concentration detecting sensor 14-3 for detecting the concentration of oxygen contained in the exhaust gas is disposed at the exhaust gas outlet; and the output of the sensor 14-3 is transmitted to the controller 13.

Based on the incineration as above with the combustion rate being controlled, the oxygen concentration in the exhaust gas is increased as in FIG. 1 in a case where a larger amount of the matter A than usual is charged because the combustion rate (per unit time) of the matter A is raised to increase amount of exhaust gas and to reduce the oxygen concentration, thereby lowering the output level of the sensor 14-3. If the oxygen concentration is reduced, the controller 13 serves to open the control valve 7 to increase the amount of air injected from the air nozzle 8 into the space above the fluidized bed 2. The amount of the air blown up from the air chamber 6 is thus decreased, and the fluidizing mode of the fluidizing medium in the fluidized bed 2 is thereby moderated. Thus, the amount of heat transferred from the fluidizing medium to the matter A is reduced and the rate of gasification of the matter A is retarded. In this way the combustion speed is made slow. At this time, the amount of oxygen in the fluidized bed 2 is reduced by decreasing the amount of air blown up from the air chamber 6, and the amount of gas not yet burnt increases in proportion to that reduction. However, the gas not burnt will be combusted when air is blown into a space such as the free board portion 9 above the fluidized bed 2 through either the air nozzle 8 or the secondary air introducing port or both.

In this case, an amount of air equivalent to the reduction in the primary air quantity $C_1$ may be supplied through the air nozzle 8 as the amount of primary air $C_2$.

Figure 13:
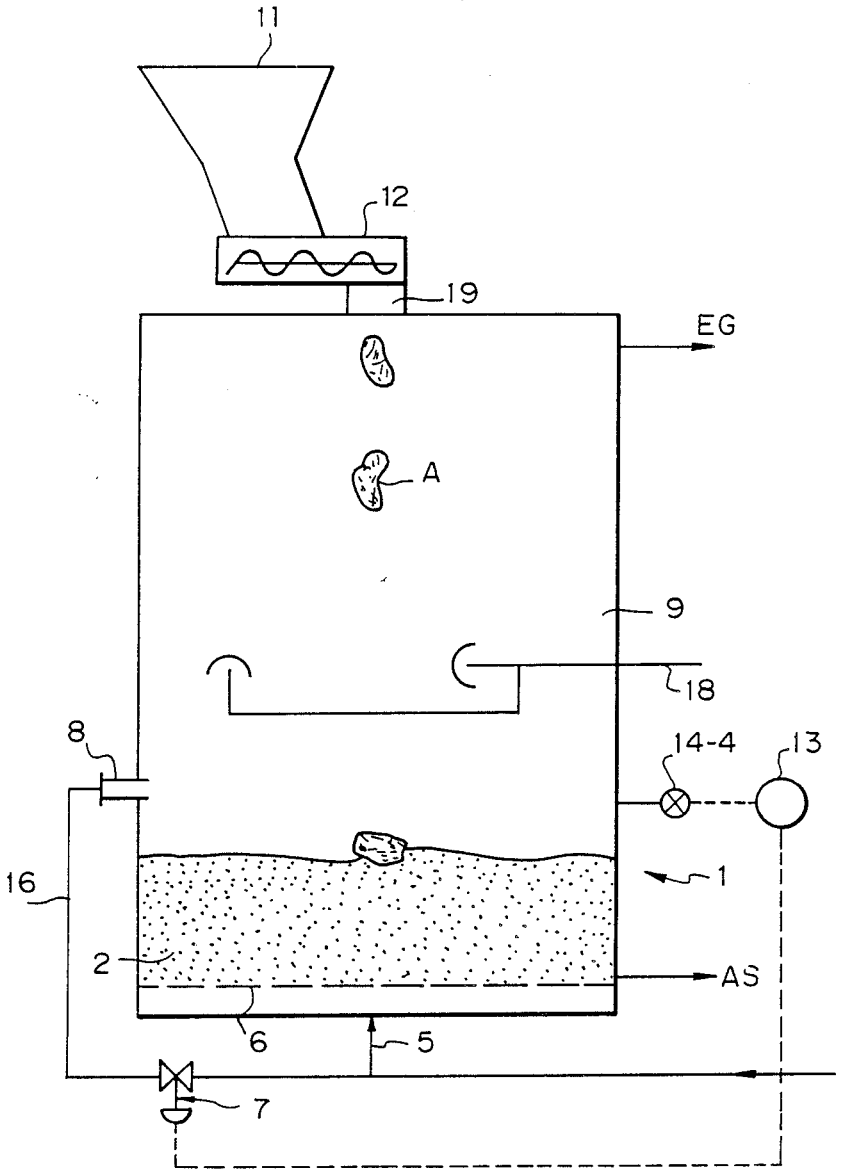
FIG. 13 is a block diagram schematically showing the construction of another fluidized bed incinerator in which the combustion control method according to the present invention is practiced.

FIG. 13 is a block diagram schematically illustrating a fluidized bed incinerator in a case where the combustion rate of the matter being incinerated in the furnace is controlled by detecting the intra-furnace temperature. In FIG. 13, the components have the same reference numerals as those used in FIG. 2 to represent the portions which are the same as or correspond to the components in FIG. 2. As illustrated in the drawing, a temperature detecting sensor 14-4 is provided above the fluidized bed 2 for detecting the temperature of the furnace 1, the output of which is transmitted to the controller 13.

Based on the control over the combustion rate which is conducted in the manner described above, if the matter for incineration A is charged in a larger amount than usual, the combustion rate (per unit time) of the matter A will be increased, and the intra-furnace temperature is thus raised, thereby raising the level of output of the temperature detecting sensor 14-4. When the intra-furnace temperature is raised, the controller 13 serves to open the control valve 7 so as to increase the amount of air injected from the air nozzle 8 into the space above the fluidized bed 2. As a result, the amount of air blown up from the air chamber 6 is reduced, and the fluidizing mode of the fluidizing medium in the fluidized bed 2 is thus moderated. Accordingly, the amount of heat transferred from the fluidizing medium to the matter for incineration A is reduced, and thus the rate of gasification of the matter A is thus retarded, thereby slowing the combustion speed. At this time, the amount of oxygen in the fluidized bed 2 is reduced by decreasing the amount of air blown up from the air chamber 6 and the amount of gas not yet burnt is increased correspondingly. However, since the air is blown into the space such as the free board portion 9 above the fluidized bed 2 by utilizing either the air nozzle 8 or the secondary air introducing port, or both, the gas that was not yet been burnt will accordingly be burnt out.

In this case, an amount of air equivalent to the reduced amount of primary air $C_1$ may be fed from the air nozzle 8 as the amount of primary air $C_2$.

Figure 14A:
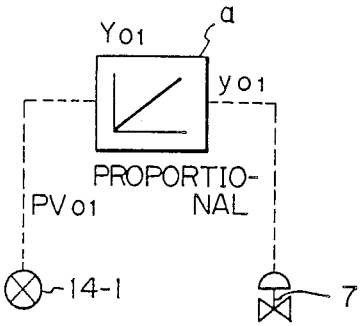
FIG. 14 (A and B) is a diagram illustrating the flow of control processes in the combustion control method according to the present invention.

In the above-described embodiments, the processes of controlling the combustion rate of the matter to be incinerated in the furnace 1 are based on the detection conducted by the brightness detecting sensor 14-1, the pressure detecting sensor 14-2, the oxygen concentration detecting sensor 14-3 and the temperature detecting sensor 14-4. There is still another control method available wherein a brightness detecting means such as the brightness detecting sensor 14-1 shown in FIG. 14(A) is employed. This control method is arranged such that an output value $PV_{01}$ of the brightness detecting sensor 14-1 is multiplied by, for example, a coefficient k (0 to 2.0), using an arithmetic unit $y_{01}$ with the suffix "a" added to it, and the opening degree of the control valve 7 is thereby regulated by an output signal $y_{01}$ proportional to the brightness.

In the case of using this latter method, there is no problem if matter for incineration such as municipal refuse is continuously fed into the furnace. However, if a so-called "massive drop" is caused due to the fact that the different materials in the refuse are inherently entangled with each other to result in abrupt combustion with the emission of smoke, failure to compensate for a malfunction in the opening degree of the control valve 7 has sometimes been observed because the furnace gets dark inside due to the emitted smoke despite the intensive combustion and the brightness detecting sensor 14-1 outputs an erroneous signal indicating that the combustion is in an inactive mode.

Figure 14B:
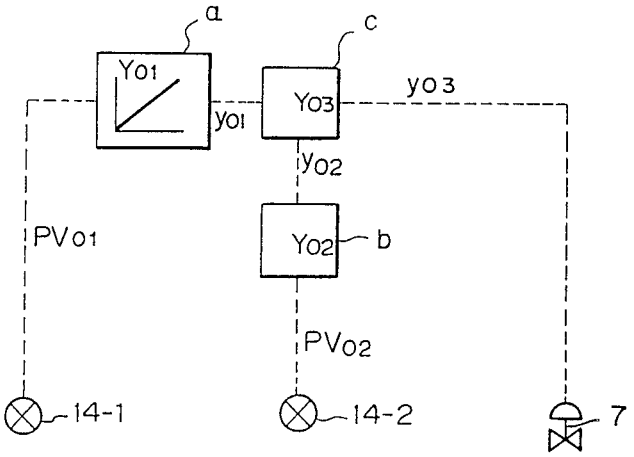

To remove these drawbacks a control method is provided which employs a combination of brightness detecting means such as the brightness detecting sensor 14-1 and intra-furnace pressure detecting means such as the pressure detecting sensor 14-2 shown in FIG. 14(B), this control method being based on the fact that the intra-furnace pressure shows a tendency to increase when combustion is activated.

If the output signal value $PV_{02}$ of the pressure detecting sensor 14-2, which corresponds to the intra-furnace pressure, exceeds a predetermined value, an arithmetic unit $y_{02}$ with a suffix "b" appended serves to output an output signal value $y_{02}$ to increase the degree of opening of the control valve 7, presently held at the minimum, to a given degree. Since the intra-furnace pressure is normally controlled, it is immediately reduced to a value under the predetermined value. When the output signal value $PV_{02}$ of the pressure detecting sensor 14-2 is reduced and maintained at a level below the present value for a predetermined period of time, output signal value $y_{02}$ representing the minimum degree of opening with respect to the control valve 7 is generated. An arithmetic unit $y_{03}$ with a suffix "c" appended compares the output signal values $y_{01}$ and $y_{02}$ with each other; the greater of the two is output as an output signal value $y_{03}$, the opening degree of the control valve 7 thus being regulated in accordance with this output signal value $y_{03}$.

With the process being effected as above, a desirable combustion control method is achieved, the control valve 7 being opened to a certain degree to function well even when the furnace becomes dark inside due to the generation of smoke. Incidentally, the arithmetic unit with the suffix "a" added may be used with an adjusting instrument to keep the intra-furnace brightness constant. The control valve 7 may be used not only for regulation of the opening degree thereof but also for regulation of a by-pass flow rate with provision of a flow rate regulator.

Similarly, if a control system capable of adequately and speedly following abrupt fluctuations in the combustion rate can be composed by combining any of such variable factors as the brightness, the intra-furnace pressure, the oxygen concentration in the exhaust gas and the intra-furnace temperature, all which change with fluctuations in the combustion rate, any combination of factors may be selected without being limited to those explained above. To summarize, the outputs of the sensors for detecting the brightness, the intra-furnace pressure, the oxygen concentration in the exhaust gas and the intra-furnace temperature need to be constantly monitored; and control should be effected solely by reference to the outputs of sensors which are properly functioning at any one time, at that time disregarding the outputs of sensors which are not properly responding to the conditions in the furnace so that optimum control can be attained.

Figure 15:
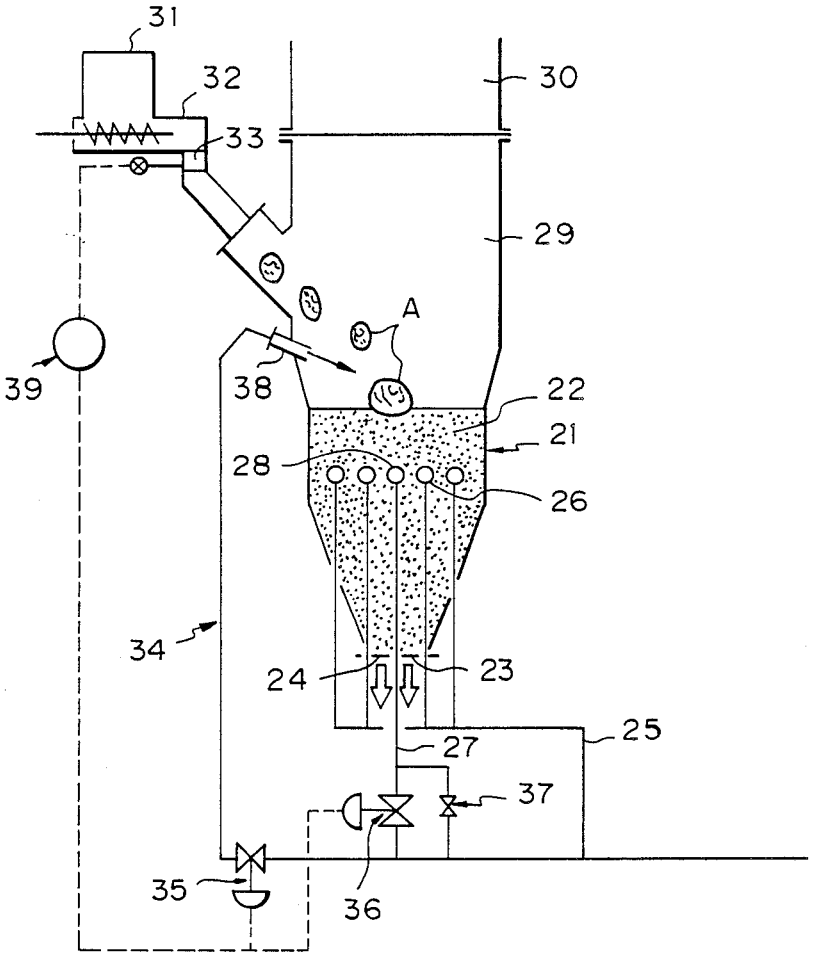
FIG. 15 is a schematic block diagram illustrating the construction of another fluidized bed incinerator in which the combustion control method according to the present invention is practiced.

Referring now to FIG. 15, a schematic block diagram of another fluidized bed incinerator is illustrated wherein a combustion control method according to the present invention is practiced in a fluidized bed incinerator. In FIG. 15, a furnace is generally designated at 21 within which a fluidized bed 22 is formed. Provided beneath the fluidized bed 22 are a plurality of air chambers 28 and 26 through which the fluidizing air is fed from a fluidizing blower (not illustrated) via a pipe 25 into the furnace 21 to fluidize the fluidizing medium. The numeral 31 denotes a hopper for charging matter to be incinerated such as municipal refuse. A feeder 32 is provided below the hopper 31 for feeding this matter into the furnace 21. A measuring unit 33 is provided at the end portion of the feeder 32 for detecting the amount of matter A fed into the furnace 21 from the hopper 31. The numeral 39 represents a unit for regulating the amount of air. Air nozzles 38 are provided on a wall of the furnace 21 for injecting air into a space above the fluidized bed 22. A shut-off valve 35 is connected via a pipe 34 to the air nozzle 38. Another shut-off valve 36 is connected through a pipe 27 to the central air chamber 28. In the drawing the reference numeral 37 designates a minimum flow valve for feeding the minimum amount of air.

In the drawing, the reference numeral 29 designates a free board portion; 30 a exhaust gas cooling unit; and 23 and 24 incombustible residue take-out ports.

In the fluidized bed incinerator constructed as above, the matter for incineration A fed from the feeder 32 into the furnace 21 is normally dropped onto a specific portion of the fluidized bed 22, i.e., on the central portion thereof. In this case, though not illustrated, the matter A may be dispersed by using a spreader. If the measuring unit 33 detects that the amount or bulk of the matter A charged into the furnace 21 is greater than usual or that the matter A is essentially combustible, an air regulating unit 39 serves to immediately close the valve 36, and to simultaneously open the valve 35. Accordingly, the amount of air fed to the central air chamber 28 becomes equivalent to the minimum amount fed through the minimum flow valve 37, this being the minimum amount required for preventing the fluidizing medium from partially leaking to the lower portion of the furnace which would lead to moderation of the fluidization mode of the fluidizing medium in that portion of the fluidized bed 22.

Simultaneously, air is injected through the air nozzle 38 into the space above the fluidized bed 22. The matter for incineration A measured by the measuring unit 33 is dropped onto the central portion of the fluidized bed 22, thereby moderating the fluidization mode of the fluidizing medium. Because of the moderated fluidization at the portion where matter A is dropped, the speed of gasification and combustion of matter A is also retarded and the amount of exhaust gas will not therefore be abruptly increased. With the decrease in amount of air fed to the fluidized bed 22, the oxygen concentration $O_2$ in the fluidized bed 22 is slightly reduced and the amount of gas remaining unburnt will be correspondingly increased. Since the air is blown into the space such as a free board portion 28 above the fluidized bed 22 through either the air nozzle 38 or the secondary air introducing port, or through both, the increased amount of the gas remaining unburnt will be incinerated.

In this case, an amount of air equivalent to the reduced amount of primary air $C_1$ may be supplied from the air nozzle 8 as the primary air quantity $C_2$.

Figure 16:
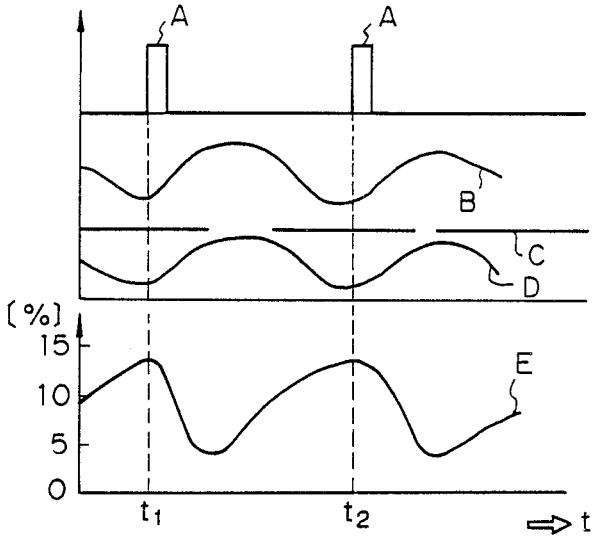
FIG. 16 is a diagram showing fluctuations in the amounts of exhaust gas, primary air, secondary air and in the concentration of oxygen contained in the exhaust gas with respect to variations over time in the quantity of matter for incineration charged into a fluidized bed incinerator having the construction shown in FIG. 15 on the basis of the conventional combustion control method.
Figure 17:
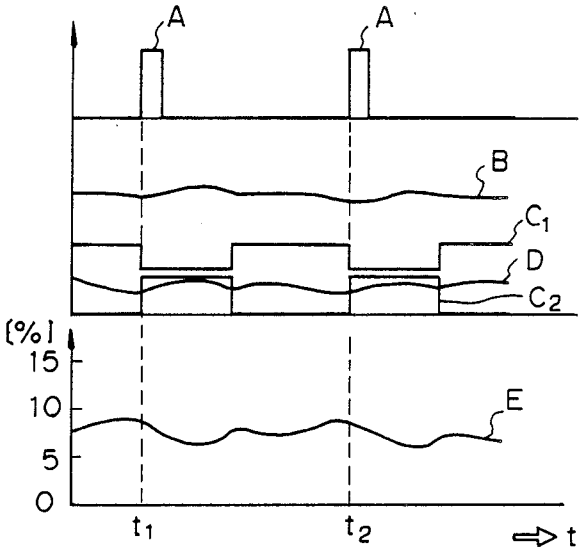
FIG. 17 is a diagram showing the fluctuations in the amounts of exhaust gas, primary air, secondary air and in the concentration of oxygen contained in exhaust gas with respect to variations over time in the quantity of the matter for incineration charged into a fluidized bed incinerator having the construction shown in FIG. 15 on the basis of the combustion control method according to the present invention.

FIG. 16 is a diagram illustrating fluctuations in the amounts of exhaust gas B, primary air C, secondary air D and oxygen concentration E in the exhaust gas, respectively, each being relative to variations over time in the amount of matter A charged on the basis of effecting the conventional combustion control method in a fluidized bed incinerator having the construction shown in FIG. 15. FIG. 17 is a diagram showing fluctuations in the amounts of exhaust gas B, primary air ($C_1$ and $C_2$), secondary air D and oxygen concentration E in the exhaust gas, respectively, each being relative to variations over time in the amount of matter A charged on the basis of the combustion control method according to the present invention.

Based on the conventional combustion control method, when the matter for incineration A is charged at a timing $t_1$, combustion is simultaneously initiated and the oxygen concentration E in the exhaust gas abruptly decreases. In response to the drop in the oxygen concentration E in the exhaust gas, the supply of secondary air D is increased and the amount of exhaust gas B is also increased. As the combustion continues, the amount of materials not yet incinerated within the furnace 21 is gradually decreased and, thus, the oxygen concentration E in the exhaust gas is increased. Consequently, the supply of secondary air quantity D is reduced, thereby causing a decrease in the amount of exhaust gas B. When the matter for incineration A is charged at a timing $t_2$, the above-mentioned mode is repeated. More specifically, marked fluctuations in the amounts of secondary air D, exhaust gas B and oxygen concentration E in the exhaust gas will be caused following charging of the matter A, depending upon the type of matter charged, and when the oxygen concentration E in the exhaust gas becomes low, gas not yet burnt is discharged.

In contrast, in the case where the combustion control method according to the present invention is employed, each time the matter A is charged at the timing of $t_1$, $t_2$ . . . , the shut-off valve 36 is simultaneously closed, and the shut-off valve 35 is simultaneously opened so that the primary air is divided upwardly and downwardly of the fluidized bed 22 with respective predetermined quantities (amount of primary air $C_2$ fed through the air nozzle 38, and amount of primary air $C_1$ fed through the air chamber 28), while the amount of secondary air D is feedback-controlled in accordance with the oxygen concentration E in the exhaust gas. When the matter A is charged at the timing $t_1$, the amount of primary air $C_1$ supplied from the lower portion of the fluidized bed 22 is decreased where the matter A drops to moderate the fluidization mode of the fluidizing medium and decrease the amount of heat transferred from the fluidizing medium to the matter for incineration A, thereby suppressing the gasification of the matter A, i.e., the combustion thereof. Because the speed of combustion is slowed, there will be no abrupt drop in the oxygen concentration E in the exhaust gas. Whilst there may be some drop, almost no fluctuation in the oxygen concentration E in the exhaust gas is observed, since the oxygen concentration E in the exhaust gas is controlled by regulating the amount of secondary air D. After a predetermined time has elapsed, the feeding of the amount of primary air $C_2$ through the air nozzle 38 is stopped, but the same amount $C_2$ is fed from the underside of the fluidized bed 22, at which time the fluidizing mode becomes active at the central portion of the fluidized bed 22. Thus the operation of the bed is restored to the normal condition. The volatile components in the furnace bed at this time have already been burnt out, so that the combustion is moderate, and there is no substantial fluctuation in the oxygen concentration and the amount of exhaust gas B, providing for stabilized condition in the furnace.

In the fluidized bed incinerator having the configuration shown in FIG. 15, a control valve may be connected to, for instance, a pipe 25, so that when a larger amount of matter A than a predetermined quantity is charged into the furnace 21, the shut-off valve 36 is closed and the opening degree of the control valve is simultaneously made small to reduce the amount of primary air $C_1$ fed through the air chamber 26, thereby increasing the amount of air injected from the air nozzle 38 into the space above the fluidized bed 22. A combustion controlling method similar to the combustion controlling method according to the present invention may be applied in combination in the fluidized bed incinerator shown in FIG. 1. Furthermore, in this case, the amount of air equivalent to the reduced amount of primary air $C_1$ may be supplied from the air nozzle 8 as the amount of primary air $C_2$. The general construction of the fluidized bed incinerator in which the foregoing control method is practiced is not limited to that shown in FIG. 15.

In each of the above-described embodiments, the description of the combustion controlling method has been given by referring to a fluidized bed incinerator. Such a fluidized bed incinerator may, as a matter of course, be replaced by a so-called fluidized bed boiler adapted for heat recovery. It is therefore apparent that the concept of the fluidized bed incinerator according to the present invention includes fluidized bed boilers.

As explained in the foregoing, the combustion control method for application to fluidized bed incinerators according to the present invention is capable of keeping substantially constant the amounts of combustion air, exhaust gas and oxygen concentration in the exhaust gas, even if the matter for incineration such as coal, municipal refuse, industrial scraps and mixtures thereof whose calorific values, properties such as combustibility, configuration and bulk volume are different from each other is charged into a fluidized bed incinerator. Therefore, in equipment which utilizes a fluidized bed incinerator for incinerating municipal refuse or the like, it is feasible to make compact such peripheral units of the fluidized bed incinerator as air blowing units for the primary air and the secondary air and exhaust gas processing units, and the construction thereof can thus be done at reduced cost. Discharge into the atmosphere of gas not yet burnt can also be suppressed to the greatest possible degree. This is beneficial in terms of preventing air pollution.

Industrial Practicality

As discussed above, the combustion control method for use in a fluidized bed incinerator according to the present invention is capable of minimizing fluctuations in the amounts of exhaust gas and oxygen concentration in the exhaust gas and of inhibiting the discharge of gas not yet burnt even when the combustion rate of matter for incineration charged into the fluidized bed incinerator is varied. Thus, this combustion control method is effective in incineration equipment incorporating a fluidized bed incinerator. Particularly in the case of burning such matter for incineration as coal, municipal refuse, industrial scraps and mixtures thereof whose calorific values, properties such as combustibility, configuration and bulk volume differ from each other, this combustion control method is capable of easily providing a highly stabilized form of combustion control and is also suitable for use in municipal refuse incineration equipment incorporating a fluidized bed incinerator or the like.

We claim:

1. A combustion control method for application in a fluidized bed incinerator for burning matter to be incinerated charged into a furnace by causing fluidization of a fluidizing medium with the assistance of air fed from a lower portion of a fluidized bed, comprising the steps of:

detecting the combustion rate of matter to be burnt in said furnace by a detecting means;

reducing the amount of air fed from the lower portion of said fluidized bed when said combustion rate exceeds a predetermined level; and restoring the amount of air fed from said lower portion to its original value when said combustion rate decreases below said predetermined level so as to control and maintain said combustion rate of said matter to be burnt in said furnace at said predetermined level.

2. A combustion control method for application in a fluidized bed incinerator for burning matter to be incinerated charged into a furnace by causing fluidization of a fluidizing medium with the assistance of air fed from a lower portion of a fluidized bed, comprising the steps of:

detecting a combustion rate of matter to be burnt in said furnace by a detecting means;

reducing the amount of air fed from the lower portion of said fluidized bed and simultaneously increasing the amount of air blown into a space above said fluidized bed when said combustion rate exceeds a predetermined level; and restoring the amount of air fed from the lower portion of said fluidized bed to its original value and simultaneously decreasing the amount of air blown into said space above said fluidized bed when said combustion rate decreases below said predetermined level so as to control and maintain said combustion rate of said matter to be burnt in said furnace at said predetermined level.

3. A combustion control method for application in a fluidized bed incinerator as set forth in claim 2, wherein the amount of air blown into said space above said fluidized bed is equal to the reduced amount of air fed from the lower portion of said fluidized bed when said combustion rate exceeds said predetermined level, and wherein the reduced amount of air blown into said space above said fluidized bed is equal to the increased amount of air fed from the lower portion of said fluidized bed when said combustion rate is decreased below said predetermined level.

4. A combustion control method for application in a fluidized bed incinerator as set forth in any one of claims 1 to 3, characterized in that said fluidized bed incinerator is operated at such a superficial velocity that the fluidizing magnification power is in a range of from 1 to 4.

5. A combustion control method for application in a fluidized bed incinerator as set forth in any one of claims 1 to 3, characterized in that a combustion rate controlling means is provided with a brightness detecting sensor for detecting an intra-furnace brightness to allow control of said combustion rate based on an output of said brightness detecting sensor.

6. A combustion control method for application in a fluidized bed incinerator as set forth in claim 5, characterized in that said brightness detecting sensor of said combustion rate controlling means is disposed above a position where secondary air is blown into the incinerator.

7. A combustion control method for application in a fluidized bed incinerator for burning matter to be incinerated charged into a furnace by causing fluidization of a fluidizing medium with the assistance of air fed from a lower portion of a fluidized bed, comprising the steps of:

providing a detecting means for detecting the amount or volume of said matter to be incinerated charged into said furnace;

providing a controlling means for controlling a combustion rate based on said amount or said volume of said matter to be incinerated charged into said furnace;

reducing the amount of air fed from the lower portion of said fluidized bed when said combustion rate of said matter to be incinerated in said furnace exceeds a predetermined level; and restoring the amount of air fed from the lower portion of said fluidized bed to its original value when said combustion rate decreases below said predetermined level so as to control and maintain said combustion rate of said matter to be incinerated in said furnace at said predetermined level.

8. A combustion control method for application in a fluidized bed incinerator for burning matter to be incinerated charged into a furnace by causing fluidization of a fluidizing medium with the assistance of air fed from a lower portion of a fluidized bed, comprising the steps of:

providing a detecting means for detecting the amount or volume of said matter to be incinerated charged into said furnace;

providing a controlling means for controlling a combustion rate based on said amount or said volume of said matter to be incinerated charged into said furnace;

reducing the amount of air fed from the lower portion of said fluidized bed and simultaneously increasing the amount of air blown into a space above said fluidized bed when said combustion rate of said matter to be incinerated in said furnace exceeds a predetermined level; and restoring the amount of air fed from the lower portion of said fluidized bed to its original value and simultaneously reducing the amount of air blown into said space above said fluidized bed when said combustion rate decreases below said predetermined level so as to control and maintain said combustion rate of said matter to be incinerated in said furnace at said predetermined level.

9. A combustion control method for application in a fluidized bed incinerator for burning matter to be incinerated charged into a furnace by causing fluidization of a fluidizing medium with the assistance of air fed from a lower portion of a fluidized bed, comprising the steps of:

providing a temperature detecting means for detecting an intra-furnace temperature;

providing a controlling means for controlling a combustion rate based on said intra-furnace temperature;

reducing the amount of air fed from the lower portion of said fluidized bed when said combustion rate of said matter to be incinerated in said furnace exceeds a predetermined level; and restoring the amount of air fed from said lower portion of said fluidized bed to its original value when said combustion rate decreases below said predetermined level so as to control and maintain said combustion rate of said matter to be incinerated in said furnace at said predetermined level.

10. A combustion control method for application in a fluidized bed incinerator for burning matter to be incinerated charged into a furnace by causing fluidization of a fluidizing medium with the assistance of air fed from a lower portion of a fluidized bed, comprising the steps of:

providing a temperature detecting means for detecting an intra-furnace temperature;

providing a controlling means for controlling a combustion rate based on said intra-furnace temperature;

reducing the amount of air fed from the lower portion of said fluidized bed and simultaneously increasing the amount of air blown into a space above said fluidized bed when the combustion rate of said matter to be incinerated in said furnace exceeds a predetermined level; and restoring the amount of air fed from the lower portion of said fluidized bed to its original value and simultaneously reducing the amount of air blown into said space above said fluidized bed when said combustion rate decreases below said predetermined level so as to control and maintain said combustion rate of said matter to be incinerated in said furnace at said predetermined level.

11. A combustion control method for application in a fluidized bed incinerator for burning matter to be incinerated charged into a furnace by causing fluidization of a fluidizing medium with the assistance of air fed from a lower portion of a fluidized bed, comprising the steps of:

providing an oxygen concentration detecting means for detecting the concentration of oxygen contained in exhaust gas;

providing a combustion rate controlling means for controlling a combustion rate based on said oxygen concentration in the exhaust gas;

reducing the amount of air fed from the lower portion of said fluidized bed when said combustion rate of said matter to be incinerated in said furnace exceeds a predetermined level; and restoring the amount of air fed from said lower portion of said fluidized bed to its original value when said combustion rate decreases below said predetermined level so as to control and maintain said combustion rate of said matter to be incinerated in said furnace at said predetermined level.

12. A combustion control method for application in a fluidized bed incinerator for burning matter to be incinerated charged into a furnace by causing fluidization of a fluidizing medium with the assistance of air fed from a lower portion of a fluidized bed, comprising the steps of:

providing an oxygen concentration detecting sensor for detecting the concentration of oxygen contained in exhaust gas;

providing a combustion rate controlling means for controlling a combustion rate based on the oxygen concentration in the exhaust gas;

reducing the amount of air fed from the lower portion of said fluidized bed and simultaneously increasing the amount of air blown into a space above said fluidized bed when said combustion rate of said matter to be incinerated in said furnace exceeds a predetermined level; and restoring the amount of air fed from the lower portion of said fluidized bed to its original value and simultaneously reducing the amount of air blown into said space above said fluidized bed when said combustion rate decreases below said predetermined level so as to control and maintain said combustion rate of said matter to be incinerated in said furnace at said predetermined level.

13. A combustion control method for application in a fluidized bed incinerator for burning matter to be incinerated charged into a furnace by causing fluidization of a fluidizing medium with the assistance of air fed from a lower portion of a fluidized bed, comprising the steps of:

providing a pressure detecting means for detecting an intra-furnace pressure;

providing a combustion rate controlling means for controlling a combustion rate based on the intra-furnace pressure;

reducing the amount of air fed from the lower portion of said fluidized bed when the combustion rate of matter to be incinerated in said furnace exceeds a predetermined level; and restoring the amount of air fed from said lower portion of said fluidizing bed to its original value when said combustion rate decreases below said predetermined level so as to control and maintain said combustion rate of said matter to be incinerated in said furnace at said predetermined level.

14. A combustion control method for application in a fluidized bed incinerator for burning matter to be incinerated charged into a furnace by causing fluidization of a fluidizing medium with the assistance of air fed from a lower portion of a fluidized bed, comprising the steps of:

providing a pressure detecting means for detecting an intra-furnace pressure;

providing a combustion rate controlling means for controlling a combustion rate based on the intra-furnace pressure;

reducing the amount of air fed from the lower portion of said fluidized bed and simultaneously increasing the amount of air blown into a space above said fluidized bed when the combustion rate of said matter to be incinerated in said furnace exceeds a predetermined level; and restoring the amount of air fed from the lower portion of said fluidized bed to its original value and simultaneously reducing the amount of air blown into said space above said fluidized bed when said combustion rate decreases below said predetermined level so as to control and maintain said combustion rate of said matter to be incinerated in said furnace at said predetermined level.

15. A combustion control method for application in a fluidized bed incinerator for burning matter to be incinerated charged into a furnace by causing fluidization of a fluidizing medium with the assistance of air fed from a lower portion of a fluidized bed, comprising the steps of:

providing a controlling a means for controlling combustion rate based on the properties or the like of said matter to be incinerated;

reducing the amount of air fed from the lower portion of said fluidized bed when the combustion rate of matter to be incinerated in said furnace exceeds a predetermined level; and restoring the amount of air fed from said lower portion of said fluidizing bed to its original value when said combustion rate decreases below said predetermined level so as to control and maintain said combustion rate of said matter to be incinerated in said furnace at said predetermined level.

16. A combustion control method for application in a fluidized bed incinerator for burning matter to be incinerated charged into a furnace by causing fluidization of a fluidizing medium with the assistance of air fed from a lower portion of fluidized bed, comprising the steps of:

providing a controlling means for controlling a combustion rate based on the properties or the like of said matter to be incinerated;

reducing the amount of air fed from the lower portion of said fluidized bed and simultaneously increasing the amount of air blown into a space above said fluidized bed when the combustion rate of said matter to be incinerated in said furnace exceeds a predetermined level; and restoring the amount of air fed from the lower portion of said fluidized bed to its original value and simultaneously reducing the amount of air blown into said space above said fluidized bed when said combustion rate decreases below said predetermined level so as to control and maintain said combustion rate of said matter to be incinerated in said furnace at said predetermined level.

17. A combustion control method for application in a fluidized bed incinerator for burning matter to be incinerated charged into a furnace by causing fluidization of a fluidizing medium with the assistance of air fed from a lower portion of a fluidized bed, comprising the steps of:

providing a brightness detecting means for detecting an intra-furnace brightness and a pressure detecting means for detecting an intra-furnace pressure;

providing a combustion rate controlling means for a controlling combustion rate based on the larger of the outputs obtained by said brightness detecting means and said pressure detecting means;

reducing the amount of air fed from the lower portion of said fluidized bed when the combustion rate of matter to be incinerated in said furnace exceeds a predetermined level; and restoring the amount of air fed from the lower portion of said fluidized bed to its original value when said combustion rate decreases below said predetermined level so as to control and maintain said combustion rate of said matter to be incinerated in said furnace at said predetermined level.

18. A combustion control method for application in a fluidized bed incinerator for burning matter to be incinerated charged into a furnace by causing fluidization of a fluidizing medium with the assistance of air fed from a lower portion of a fluidized bed, comprising the steps of:

providing a brightness detecting means for detecting an intra-furnace brightness and a pressure detecting means for detecting an intra-furnace pressure;

providing a combustion rate controlling means for a controlling a combustion rate based on the larger of the outputs obtained by the said brightness detecting means and said pressure detecting means;

reducing the amount of air fed from the lower portion of said fluidized bed and simultaneously increasing the amount of air blown into a space above said fluidized bed when the combustion rate of said matter to be incinerated in said furnace exceeds a predetermined level; and restoring the amount of air fed from the lower portion of said fluidized bed to its original value and simultaneously reducing the amount of air blown into said space above said fluidized bed when said combustion rate decreases below said predetermined level so as to control and maintain said combustion rate of said matter to be incinerated in said furnace at said predetermined level.

19. A combustion control method for application in a fluidized bed incinerator as set forth in any one of claims 1–3 or 7–18, characterized in that said fluidized bed incinerator is constructed to include a plurality of air chambers provided at the lower portion of said fluidized bed, through which chambers air is fed into the incinerator.

20. A combustion control method for application in a fluidized bed incinerator as set forth in any one of claims 1–3 or 7–18, wherein the constituents of said matter to be incinerated are different from each other in calorific value and properties such as combustibility, configuration and volume.

21. A combustion control method for application in a fluidized bed incinerator as set forth in any one of claims 1–3 or 7–18, characterized in that said matter to be incinerated which is charged comprises coal, industrial scraps and municipal refuse or mixtures thereof.

22. A combustion control method for application in a fluidized bed incinerator as set forth in any one of claims 1–3 or 7–18, wherein said fluidized bed incinerator involves a fluidized bed boiler.

23. A combustion control method for application in a fluidized bed incinerator as set forth in claim 1 or claim 3, characterized in that a plurality of air chambers are provided at the lower portion of said incinerator to feed air for fluidization, and the reduction in the amount of air is effected at the particular air chamber located at the portion where said matter charged drops thereabove.

* * * * *